US012156576B1

(12) United States Patent
Lennon

(10) Patent No.: US 12,156,576 B1
(45) Date of Patent: Dec. 3, 2024

(54) LUGGAGE ASSEMBLY WITH A SELECTIVELY ILLUMINUATING LIGHT

(71) Applicant: Juney V. Lennon, West Palm Beach, FL (US)

(72) Inventor: Juney V. Lennon, West Palm Beach, FL (US)

( * ) Notice: Subject to any disclaimer, the term of this patent is extended or adjusted under 35 U.S.C. 154(b) by 0 days.

(21) Appl. No.: 17/300,367

(22) Filed: Dec. 20, 2021

(51) Int. Cl.

| | |
|---|---|
| ***A45C 15/06*** | (2006.01) |
| ***A45C 5/03*** | (2006.01) |
| ***A45C 5/14*** | (2006.01) |
| ***A45C 13/26*** | (2006.01) |

(52) U.S. Cl.
CPC ..... *A45C 15/06* (2013.01); *A45C 5/03* (2013.01); *A45C 5/14* (2013.01); *A45C 13/262* (2013.01)

(58) Field of Classification Search
CPC ..... A45C 15/06; A45C 13/267; A45C 5/03
USPC ..... 190/18 A; 362/156
See application file for complete search history.

(56) References Cited

U.S. PATENT DOCUMENTS

| | | | | |
|---|---|---|---|---|
| 10,123,603 | B1 * | 11/2018 | Glickman | A45C 5/03 |
| 10,825,324 | B2 * | 11/2020 | Haviv | H04W 12/126 |
| 2003/0132842 | A1 * | 7/2003 | Chia-Yen | G08B 21/24 340/568.1 |
| 2010/0003926 | A1 * | 1/2010 | Sahara | H04W 52/262 455/73 |
| 2010/0264854 | A1 * | 10/2010 | Kennedy | A45C 15/06 362/156 |

* cited by examiner

*Primary Examiner* — Sue A Weaver

(57) ABSTRACT

A luggage assembly with a selectively illuminating light including a luggage body, a handle defining an opening for a user to grasp and surround a portion of the handle thereon, a light housing with a light disposed therein and coupled to a receiver, wherein the light housing and the receiver are coupled to the front surface of the luggage body. Additionally, the assembly includes a handheld remote assembly with a handheld housing, a battery source disposed within the handheld housing, a transmitter coupled to the handheld housing, and a first button disposed on the front surface of the handheld housing, electrically couplable to the battery source, and operably configured to be selectively depressed to selectively emit a signal to the receiver coupled to the light housing on the front surface of the luggage body and emit a light therefrom.

3 Claims, 3 Drawing Sheets

LUGGAGE ASSEMBLY WITH A SELECTIVELY ILLUMINUATING LIGHT

FIELD OF THE INVENTION

The present invention relates generally to luggage or handheld carrying containers with illumuinating lights and, more particularly, relates to a piece of luggage with selectively illuminating lights coupled thereto.

SUMMARY OF THE INVENTION

The invention provides a luggage assembly with a selectively illuminating light thereon that overcomes the hereinafore-mentioned disadvantages of the heretofore-known devices and methods.

With the foregoing and other objects in view, there is provided, in accordance with the invention, a luggage assembly with a selectively illuminating light that includes a luggage body with an upper surface, with a bottom surface opposing the upper surface of the luggage body, with a rear surface, and with a front surface opposing the rear surface of the luggage body. Further, the assembly includes a handle defining an opening for a user to grasp and surround a portion of the handle thereon, a light housing with a light disposed therein and coupled to a receiver, the light housing and the receiver coupled to the front surface of the luggage body, and a handheld remote assembly with a handheld housing having a front surface and a rear surface opposing the front surface of the handheld housing, a battery source disposed within the handheld housing, a transmitter coupled to the handheld housing, and a first button disposed on the front surface of the handheld housing. The first button is electrically couplable to the battery source, and is operably configured to be selectively depressed to selectively emit a signal to the receiver coupled to the light housing on the front surface of the luggage body and emit a light therefrom.

In accordance with a further feature of the present invention, the receiver surrounds and radially projects outwardly from a periphery of the light housing.

In accordance with another feature, an embodiment of the present invention includes the handheld housing having a key ring coupled to an outer surface of the handheld housing.

In accordance with yet another feature, an embodiment of the present invention also includes the luggage body having a plurality of wheels coupled to the bottom surface of the luggage body.

Although the invention is illustrated and described herein as embodied in a luggage assembly with a selectively illuminating light thereon, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale. In this document, the term "longitudinal" should be understood to mean in a direction corresponding to an elongated direction of the piece of luggage from a bottom end to a top end thereon.

DETAILED DESCRIPTION

Figure 3:
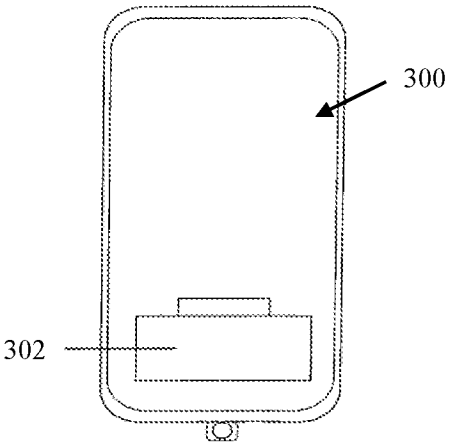
FIGS. 1-3 depict overhead perspective views of a battery operated handheld remote assembly with a key ring coupled to keys and buttons thereon for selectively emitting a signal to a receiver on a piece of luggage to cause a light structure to switch on and emit a light therefrom.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient luggage assembly with a selectively illuminating light. Referring now to FIGS. 1-5, embodiments of the present invention are shown in perspective views. Specifically, the luggage assembly with the selectively illuminating light can be seen having a luggage body 500 (FIG. 5) that has an upper surface 502, a bottom surface 504 opposing the upper surface of the luggage body 500, a rear surface 506, and a front surface 508 opposing the rear surface 506 of the luggage body 500. As known, the luggage may be selectively opened by the user to store items. In one embodiment, the luggage body 500 includes a plurality of wheels 502*a-b* coupled to the bottom surface 504 of the luggage body 500 for rolling the luggage body (as depicted in FIG. 5). Further, the luggage body 500 may include a handle 504 defining an opening for a user to grasp and surround a portion of the handle 504 thereon and that extends upwardly from the upper surface 502 of the luggage body 500.

Figure 4:
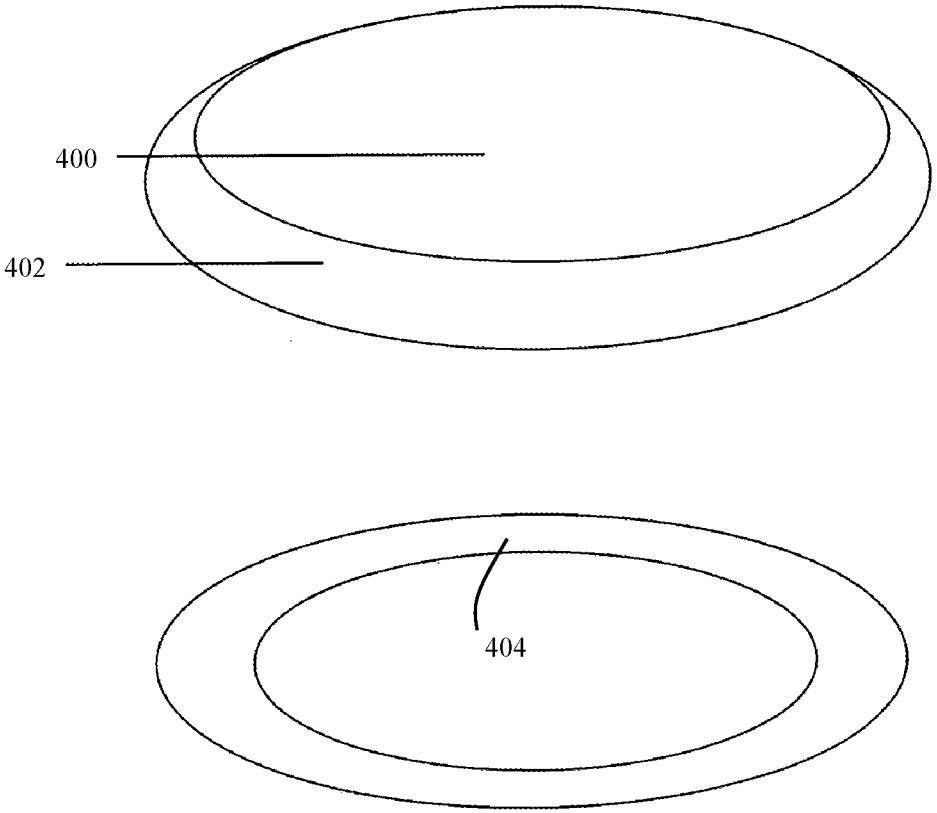
FIG. 4 depicts a perspective view of a receiver electrically coupled to a light structure and an annular adhesive ring utilized to couple the receiver and light structure to a piece of luggage.
Figure 5:
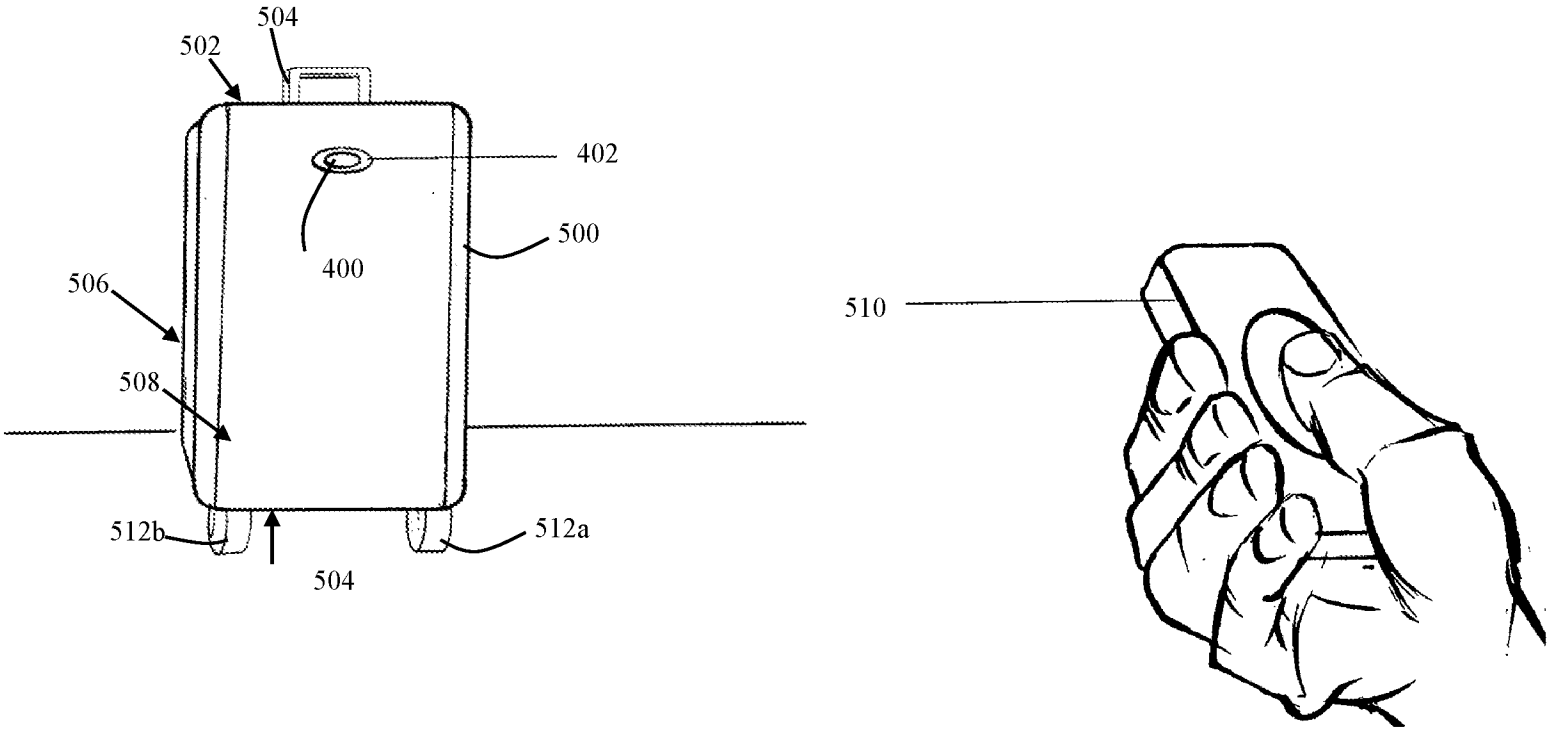
FIG. 5 is a perspective view of a user holding a battery operated handheld remote assembly, depressing a button thereon, and switching on a light structure having a receiver connected thereon in accordance with the present invention.

With specific reference to FIGS. 4-5, the assembly also includes a light housing 400 with a light disposed therein and that is coupled to a receiver 402. The light housing 400 and the receiver 402 are coupled to the front surface 508 of the luggage body 500 so they can be seen from the front of the luggage body 500. In one embodiment, an annular ring

404 is utilized to connect the light housing 400 and receiver 402 to the luggage body 500.

Reference back to FIGS. 1-5, the assembly also includes a handheld remote assembly 100 with a handheld housing 102 having a front surface 104 and a rear surface 300 opposing the front surface 104 of the handheld housing. The handheld housing 102 also includes side surfaces or walls of the handheld housing 102. The handheld housing 102 also includes a battery source 302 disposed within the handheld housing 102. As known in the art, the remote assembly includes a transmitter configured to emit signals and is coupled to the handheld housing 102. Additionally, the handheld housing 102 may include buttons 106*a-b* to switch on a first or second light on the light housing 400. The buttons 106*a-b* are disposed on the front surface 104 of the handheld housing 102 and are electrically couplable to the battery source 302. The buttons 106*a-b* are also operably configured to be selectively depressed (exemplified best in FIG. 5) to selectively emit a signal to the receiver 402 coupled to the light housing 400. When the signal is received, the light housing 400 emits a light therefrom (i.e., switch on the light).

Figure 2:
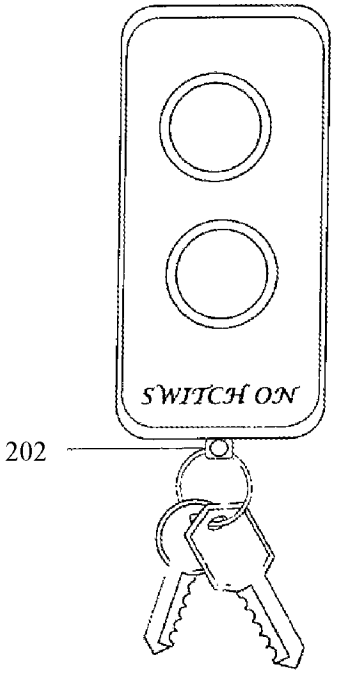
Figure 1:
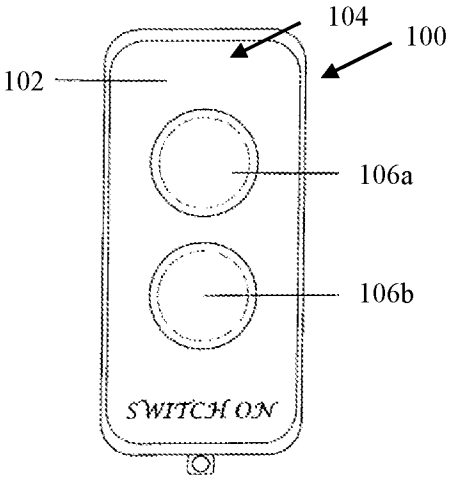

In one embodiment (as best seen in FIG. 4), the receiver 402 surrounds and radially projects outwardly from a periphery of the light housing 400. Further, as best seen in FIG. 2, the handheld housing 102 includes a key ring 202 coupled to an outer surface of the handheld housing 102 and for receiving keys, attached to another key ring, thereon. It should be understood that terms such as, "front," "rear," "side," top," "bottom," and the like are indicated from the reference point of a viewer viewing the luggage or remote as seen in the figures.

What is claimed is:

1. A luggage assembly with a selectively illuminating light comprising:

a luggage body with an upper surface, with a bottom surface opposing the upper surface of the luggage body, with a rear surface, and with a front surface opposing the rear surface of the luggage body;

a handle defining an opening for a user to grasp and surround a portion of the handle thereon;

a light housing with a light disposed therein and coupled to a receiver, the light housing and the receiver coupled to the front surface of the luggage body; and a handheld remote assembly with a handheld housing having a front surface and a rear surface opposing the front surface of the handheld housing, a battery source disposed within the handheld housing, a transmitter coupled to the handheld housing, and a first button disposed on the front surface of the handheld housing, electrically couplable to the battery source, and operably configured to be selectively depressed to selectively emit a signal to the receiver coupled to the light housing on the front surface of the luggage body and emit a light therefrom;

wherein the receiver surrounds and radially projects outwardly from a periphery of the light housing.

2. The luggage assembly according to claim 1, wherein the handheld housing further comprises a key ring coupled to an outer surface of the handheld housing.

3. The luggage assembly according to claim 1, wherein the luggage body further comprises a plurality of wheels coupled to the bottom surface of the luggage body.

* * * * *